US007266336B2

(12) United States Patent
Ueno et al.

(10) Patent No.: US 7,266,336 B2
(45) Date of Patent: Sep. 4, 2007

(54) FIXING APPARATUS AND AN IMAGE FORMATION APPARATUS

(75) Inventors: Satoshi Ueno, Tokyo (JP); Ken Omura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 269 days.

(21) Appl. No.: 11/055,636

(22) Filed: Feb. 11, 2005

(65) Prior Publication Data

US 2005/0191098 A1 Sep. 1, 2005

(30) Foreign Application Priority Data

Feb. 12, 2004 (JP) ..... 2004-034510
Jun. 28, 2004 (JP) ..... 2004-189438

(51) Int. Cl.
*G03G 15/20* (2006.01)

(52) U.S. Cl. ..... 399/329; 219/216

(58) Field of Classification Search ..... 399/67, 399/107, 122, 320, 328, 329, 330, 331; 219/216
See application file for complete search history.

(56) References Cited

U.S. PATENT DOCUMENTS 6,668,151 B2 * 12/2003 Uehara et al. ..... 399/328
7,099,616 B2 * 8/2006 Kato et al. ..... 399/328
2005/0191098 A1 9/2005 Ueno et al.
2006/0029411 A1 * 2/2006 Ishii et al. ..... 399/67

FOREIGN PATENT DOCUMENTS

| | | |
|---|---|---|
| JP | 11-109774 | 4/1999 |
| JP | 2001-34097 | 2/2001 |
| JP | 2002-82549 | 3/2002 |
| JP | 2002-352948 | 12/2002 |
| JP | 2004-77892 | * 3/2004 |

OTHER PUBLICATIONS

U.S. Appl. No. 11/520,649, filed Sep. 14, 2006, Omura.
U.S. Appl. No. 11/422,227, filed Jun. 5, 2006, Ueno.

* cited by examiner

*Primary Examiner*—Hoan Tran
(74) *Attorney, Agent, or Firm*—Oblon, Spivak, McClelland, Maier & Neustadt, P.C.

(57) ABSTRACT

A fixing apparatus and an image formation apparatus therewith are disclosed. According to the fixing apparatus, a heating range that is heated by electromagnetic induction caused by a current flowing through a coil unit is finely tunable by covering a part of a core unit with a shielding member. Further, the core unit has a projecting section at an end of the core unit, which projecting section projects toward the coil unit in comparison with the central part of the core unit.

27 Claims, 7 Drawing Sheets

FIXING APPARATUS AND AN IMAGE FORMATION APPARATUS

BACKGROUND OF THE INVENTION

1. Field of the Invention

The present invention generally relates to an image formation apparatus using electro photography, such as copying machines, printers, facsimile apparatuses, and compound machines; and a fixing apparatus thereof. Further, the present invention especially relates to a fixing apparatus and an image formation apparatus that are capable of forming an image on two or more kinds of recording media that have different dimensions.

2. Description of the Related Art

A fixing apparatus using an electromagnetic-induction heating (IH) method has been known, which aims at saving energy by shortening the standup time of an image formation apparatus, such as a copying machine and a printer (for example, Patent Reference 1).

According to Patent Reference 1, for example, the fixing apparatus of an electromagnetic-induction heating method includes a fixing belt, serving as a fixing member, that is installed with tension, and supported by a heating roller and a fixing roller, an electromagnetic-induction heating unit (IH unit) that is installed countering the heating roller with the fixing belt in-between, and a pressurizing roller that is installed countering the fixing roller with the fixing belt in-between. Further, the IH unit includes a coil unit and a core that is installed countering the coil unit, the coil unit being installed in the directions of the width (the directions that perpendicularly intersect the conveyance direction of the recording medium).

Here, the fixing belt is heated at a position that counters the IH unit. The heated fixing belt provides heat to a toner image on the recording medium conveyed to the position of the fixing roller and the pressurizing roller such that the toner image is fixed. Specifically, a high frequency alternating current is provided to the coil unit, which generates a magnetic field around the coil unit, causing an eddy current to arise on the surface of the heating roller. The eddy current in the heating roller generates the Joule heat with the electric resistance of the heating roller. The Joule heat raises the temperature of the fixing belt that is installed around the heating roller.

It is known that the IH heating method raises the temperature of the surface of the fixing belt (fixing temperature) to a desired temperature with a small amount of energy and in a short time.

Further, Patent Reference 2, for example, discloses a technology of dividing an IH coil (coil unit) of the fixing member into two or more sections in the width directions, aiming at preventing the temperature from rising at places where the recording medium does not pass, when the width of the recording medium is small. According to this technology, two or more IH coils are installed in the width directions, and power is supplied only to one or more selected IH coils such that the heating range in the width directions is optimized.

Further, Patent Reference 3, for example, discloses a fixing apparatus that uses the IH method, wherein two or more core units are arranged in the width directions in the fixing member (heating member), aiming at preventing the temperature from rising at places where the recording medium does not pass when the width of the recording medium is small. According to this technology, a bimetal member used such that, based on the temperature distribution of the fixing member in the width directions, core units near a high temperature part are moved far from the fixing member. In this way, a local temperature rise of the fixing member in the width directions is prevented from occurring.

Further, Patent Reference 4, for example, proposes a fixing apparatus using the IH method, and including a shielding member (a magnetic-flux shielding plate) aiming at preventing the temperature rise at places of the fixing member (heating medium) where the recording medium does not pass when the width of the recording medium is small, the shielding member having a circle-curved surface. According to this technology, the shielding member is rotated such that the heating range in the width directions is made the same as the width of the recording medium, and the temperature at both ends in the width directions of the fixing member is prevented from rising.

[Patent reference 1] JPA, 2002-82549

[Patent reference 2] JPA, 2001-34097

[Patent reference 3] JPA, 11-109774

[Patent reference 4] JPA, 2002-352948

[Problem(s) to be Solved by the Invention]

Image formation apparatuses having the conventional fixing member as described above have various problems caused by preventing the temperature rise at both ends in the width directions when fixing a recording medium having a small width.

The problems are specifically described as follows.

Common image formation apparatuses are capable of performing an image formation on several kinds of recording media with different widths. Here, the widths include JIS sizes, such as A-sequence and B-sequence, and non-standard widths. Even in the case of the standard sizes, the recording media may be conveyed in the direction of the longitude and in the perpendicular direction thereof, which constitute different widths.

When the fixing apparatus processes the recording media having different widths, heat distribution of the fixing member in the width directions becomes uneven depending on the widths of the recording media. When a recording medium having a small width is fixed, heat is consumed over the width of the recording medium (paper passing range, central position), and the temperature of the paper passing range is lowered as compared with other ranges (non paper passing range, end positions). This phenomenon becomes especially remarkable when the small width recording media are continuously processed.

While controlling the temperature of the central position of the fixing member in the width directions is possible, it is difficult to control the temperature on both ends of the fixing member, where the temperature undesirably rises. Especially, with the fixing member using the IH method, the temperature of the fixing apparatus quickly rises. When the heat at both ends of the fixing member is not transferred, the temperature quickly rises. If, under this circumstance, a recording medium having a great width is fixed, "hot offset" will occur toward both ends in the width directions of the recording medium. Further, if the temperature of both ends exceeds a thermal breakage temperature, it is conceivable that the fixing member will be thermally damaged, and the service life of the fixing member will be shortened.

In order to solve the problem as described above, Patent Reference 2 provides two or more electromagnetic-induction coils arranged in the width directions, and a heating range of the fixing member is adjusted in accordance with the width of a recording medium.

According to this technology, however, electromagnetic-induction coils that are of a complicated structure have to be prepared, and have to be individually controlled in accordance with various widths of the recording media. Due to the complicated structure and control, the solution tends to be costly. Further, since there arise gaps between the electromagnetic induction coils, the temperature of the heating member at positions corresponding to the gaps tends to be lower than required, causing poor fixing at the positions.

According to a solution proposed by Patent Reference 3, for example, two or more core units are installed in the width directions, and a bimetal member is provided to the core units located at each end of the width. The bimetal member causes the core units located at each end of the width to separate from the fixing member if the temperature at the end positions rises because there is no recording medium.

This technology also requires two or more core units corresponding to various widths of the recording media, and the core units have to be individually controlled by the bimetal member. Accordingly, the structure and control tend to be complicated, and cost tends to be high. Further, there arise gaps between the core units. Positions on the heating member corresponding to the gaps cannot be properly heated, causing poor fixing at the positions.

In order to solve the problems arising from providing two or more electromagnetic-induction coils and core units in the width directions, a method is conceived wherein magnetic flux at both ends in the width directions is shielded by a shielding member. Namely, Patent Reference 4, for example, discloses a technology wherein a shielded range is made variable according to the width of the recording medium such that the range wherein the magnetic flux is shielded at both ends of the width is adjustable. In this manner, it is expected that even heating of the fixing member will be available in accordance with the width of the recording media.

However, even in this case, when the shielding of the core unit by the shielding member is completely open (i.e., heating range is maximized), the temperature of both ends of the fixing member in the width directions is lowered. For this reason, when a recording medium with a great width is to be fixed, poor fixing tends to occur at both ends of the recording medium in the width directions.

Further, when the heating range is made variable by varying the shielded range at both ends in the width directions according to the width of the recording media, as the technology of Patent Reference 4, the heating range tends to fluctuate. If the heating range of the fixing member in the width directions fluctuates, "hot offset" and "cold offset" occur at both ends of the recording medium in the width directions after a fixing process. Specifically, when the heating range is greater than desired, the temperature at both ends of the fixing member in the width directions is raised, and "hot offset" occurs. If the heating range is smaller than desired, "cold offset" occurs.

SUMMARY OF THE INVENTION

It is a general object of the present invention to provide a fixing apparatus and an image formation apparatus that substantially obviate one or more of the problems caused by the limitations and disadvantages of the related art.

The present invention is made in order to solve the problems as described above, and offers a fixing apparatus and an image formation apparatus wherein the temperature at both ends of the fixing member is kept low even when recording media having a small width are continuously processed, while producing a good quality image on recording media of different widths.

Features and advantages of the present invention are set forth in the description that follows, and in part will become apparent from the description and the accompanying drawings, or may be learned by practice of the invention according to the teachings provided in the description. Objects as well as other features and advantages of the present invention will be realized and attained by a fixing apparatus and an image formation apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides as follows.

[Unit for Solving the Problem]

The inventor hereto has learned the following matter, as a result of research in order to solve the above-mentioned problems.

That is, when preparing a shielding member in order to shield a part of a core unit, the size of the core unit is restricted by that much of the shielding member. Further, even when the shielding member is completely open, a part of magnetic flux at both ends in the width directions is intercepted by the shielding member, and the temperature of both ends in the width directions of the fixing member falls.

The present invention is based on the matter described above. An aspect of the present invention provides a fixing apparatus that includes a fixing member configured to heat a toner image on a recording medium such that the toner image is fixed to the recording medium, a coil unit that is installed facing the fixing member in the width directions, a core unit that faces the coil unit, and a shielding member that shields a part of the core unit in the width directions such that a heating range is made variable in the width directions of the fixing member that is heated by electromagnetic induction when a current flows through the coil unit, wherein the coil unit has a projecting section at both ends in the width direction, the projecting section projecting toward the coil unit with reference to the central part in the width directions.

This fixing apparatus is called the first fixing apparatus for distinction purposes in the following.

According to another aspect of the present invention, the projecting section of the first fixing apparatus faces the core unit at least when the heating range is maximized.

According to another aspect of the present invention, the core unit of the first fixing apparatus is formed in the shape of one of a solid cylinder and a hollow cylinder, having a larger diameter part on each end in the width directions, the larger diameter part serving as the projecting section.

According to another aspect of the present invention, the central axis of the larger diameter part of the core unit of the first fixing apparatus is made eccentric to the central axis of the central part, in the width directions, of the core unit.

According to another aspect of the present invention, the core unit and the coil unit of the first fixing apparatus face each other with the fixing member in between.

According to another aspect of the present invention, the fixing member of the first fixing apparatus is a fixing belt that is installed with tension, and supported by a heating roller and a fixing roller, wherein the heating roller is installed facing the coil unit that faces the perimeter side of the fixing belt, the fixing belt running between the heating roller and the coil unit, and the fixing roller is arranged facing a pressurizing roller with the fixing belt in between, the pressurizing roller pressurizing the recording medium conveyed. Further, the core unit and the shielding member are arranged in the heating roller.

According to another aspect of the present invention, the core unit and the shielding member of the first fixing apparatus are rotatably arranged in one body, and the rotation of the core unit and the shielding member by a predetermined angle changes the heating range.

According to another aspect of the present invention, the shielding member of the first fixing apparatus is arranged such that the heating range can be gradually increased and decreased, and the heating range that is adjusted corresponding to the width of the recording medium can be finely adjusted.

According to another aspect of the present invention, the shielding member of the first fixing apparatus has two or more adjustment positions for finely adjusting a given width.

According to another aspect of the present invention, the adjustment positions of the shielding member of the first fixing apparatus are formed in one of the shape of a taper and the shape of a stage.

According to another aspect of the present invention, the first fixing apparatus includes a temperature detecting unit configured to detect the temperature of either the fixing member or the heating member that contacts the fixing member, wherein driving of the shielding member is controlled based on the detected temperature.

According to another aspect of the present invention, the temperature detecting unit of the first fixing apparatus is installed at an end in the width directions of the fixing member or the heating member, as applicable.

According to another aspect of the present invention, the temperature detecting unit of the first fixing apparatus detects the temperature of the fixing member or the heating member, as applicable, when heating thereof is started.

According to another aspect of the present invention, when a temperature detected by the temperature detecting unit of the first fixing apparatus becomes higher than a predetermined temperature, the shielding member is driven such that the heating range becomes smaller.

According to another aspect of the present invention, the first fixing apparatus further includes a recognizing unit that recognizes the width, and the number of sheets of the recording media to be fixed, wherein the shielding member is driven based on a result of the recognition.

The present invention further provides a second fixing apparatus that includes a fixing member that heats a toner image on a recording medium, and fixes the toner image on the recording medium, a coil unit installed facing the fixing member in the width directions, a core unit installed facing the coil unit, and a shielding member that shields a part of the core unit in the width directions such that a heating range in the width directions may be variable, the heating range being of the fixing member that is heated by electromagnetic induction when a current flows through the coil unit, wherein the shielding member of the fixing apparatus is arranged such that the heating range can be gradually increased and decreased, and the heating range that is adjusted corresponding to the width of the recording medium can be finely adjusted.

According to another aspect of the present invention, the shielding member of the second fixing apparatus has two or more adjustment positions for finely adjusting a given width.

According to another aspect of the present invention, the adjustment positions of the shielding member of the second fixing apparatus are formed in one of the shape of a taper and the shape of a stage.

According to another aspect of the present invention, the second fixing apparatus includes a temperature detecting unit configured to detect the temperature of either the fixing member or the heating member that contacts the fixing member, wherein driving of the shielding member is controlled based on the detected temperature.

According to another aspect of the present invention, the temperature detecting unit of the second fixing apparatus is installed at an end in the width directions of the fixing member or the heating member, as applicable.

According to another aspect of the present invention, the temperature detecting unit of the second fixing apparatus detects the temperature of the fixing member or the heating member, as applicable, when heating thereof is started.

According to another aspect of the present invention, when a temperature detected by the temperature detecting unit of the second fixing apparatus becomes higher than a predetermined temperature, the shielding member is driven such that the heating range becomes smaller.

According to another aspect of the present invention, the second fixing apparatus further includes a recognizing unit that recognizes the width and the number of sheets of the recording media to be fixed, wherein the shielding member is controlled based on a result of the recognition.

According to another aspect of the present invention, the core unit and the coil unit of the second fixing apparatus face each other with the fixing member in between.

According to another aspect of the present invention, the fixing member of the second fixing apparatus is a fixing belt that is installed with tension and supported by a heating roller and a fixing roller, wherein the heating roller is installed facing the coil unit that faces the perimeter side of the fixing belt, the fixing belt running between the heating roller and the coil unit, and the fixing roller is arranged facing a pressurizing roller with the fixing belt in between, the pressurizing roller pressurizing the recording medium conveyed. Further, the core unit and the shielding member are arranged in the heating roller.

According to another aspect of the present invention, the core unit and the shielding member of the second fixing apparatus are rotatably arranged in one body, and the rotation of the core unit and the shielding member by a predetermined angle changes the heating range.

Further, the present invention provides an image formation apparatus that includes one of the first and the second fixing apparatuses as described above.

[Effect of the Invention]

According to the present invention, the heating range in the width directions of the fixing member is made variable by using the shielding member that shields a part of the core unit, and the end positions in the width directions of the core unit are projected toward the coil unit, and the heating range in the width directions of the fixing member can be finely adjusted by using the shielding member that shields a part of the core unit.

In this manner, the temperature rise at both ends of the fixing member in the width directions is suppressed, even when a small width recording medium is continuously fixed; and the fixing apparatus and the image formation apparatus that are capable of providing satisfactory fixing to different widths of the recording media are offered.

DESCRIPTION OF THE PREFERRED EMBODIMENTS

Figure 1:
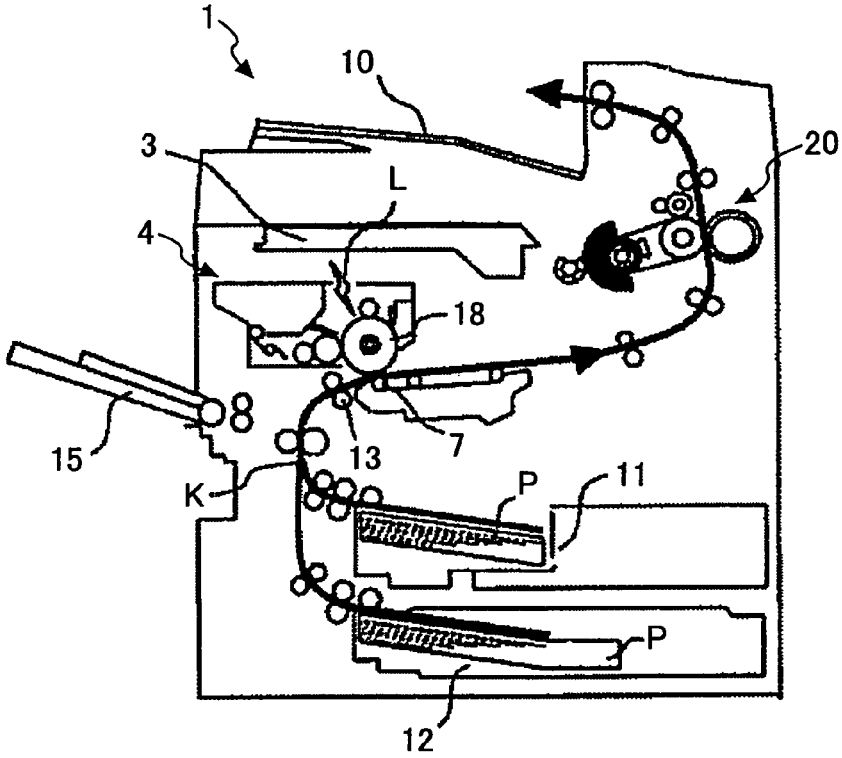
FIG. 1 is a side view of an image formation apparatus according to Embodiment 1 of the present invention.

In the following, embodiments of the present invention are described with reference to the accompanying drawings.

In the following, the same reference mark is given to the same unit in the drawings, and explanations thereof are not repeated.

Embodiment 1

Embodiment 1 of the present invention is described in detail with reference to FIGS. 1 through 4.

First, the overall structure and operation of an image formation apparatus 1 according to Embodiment 1 are described.

As shown in FIG. 1, the image formation apparatus 1 includes an exposure unit 3 that irradiates an exposure light L based on image information to a photo conductor drum 18, a process cartridge 4 that is detachably installed in the image formation apparatus 1, a transferring unit 7 that transfers a toner image formed on the photo conductor drum 18 to a recording medium P, a delivery tray 10 to which an output image is discharged, feed units 11 and 12 that store the recording media P, such as imprint paper, a resist roller 13 that conveys the recording medium P to the transferring unit 7, a manual feed unit 15 that feeds a recording medium P often having sizes different from the recording medium P stored by the feed units 11 and 12, and a fixing unit 20 that fixes the toner image to the recording medium P.

With reference to FIG. 1, image formation operations of the image formation apparatus are described.

First, the exposure unit 3 (write-in unit) irradiates the exposure light L, such as a laser beam, based on the image information to the surface of the photo conductor drum 18 of the process cartridge 4. The photo conductor drum 18 rotates counterclockwise (ref. FIG. 1), and a toner image corresponding to the image information is formed on the photo conductor drum 18 through predetermined imaging processes (an electrification process, an exposure process, and a development process).

Then, the toner image formed on the photo conductor drum 18 is transferred to the recording medium P by the transferring unit 7, the recording medium P being conveyed by the resist roller 13.

Operations about the recording medium P conveyed to the transferring unit 7 are as follows.

First, one of the feed units 11 and 12 is selected either manually or automatically. In the present description, it is assumed that the feed unit 11 is chosen. Here, the recording medium P stored in the feed unit 11 and the recording medium P stored in the feed unit 12 are different in sizes, or direction of placement.

A sheet of the recording medium P that is placed on the top in the feed unit 11 is conveyed along a conveyance route K. Then, the recording medium P arrives at the resist roller 13. There, the recording medium P waits such that the toner image formed on the photo conductor drum 1 is transferred at a proper position of the recording medium P. At the proper timing, the recording medium P is conveyed to the transferring unit 7.

Then, the transferring unit 7 transfers the toner image to the recording medium P that is then conveyed to the fixing apparatus 20. The recording medium P that reaches the fixing apparatus 20 is inserted between the fixing belt and the pressurizing roller. There, the toner image is fixed by heat provided by the fixing belt, and pressure provided by the pressurizing roller. Then, the recording medium P to which the toner image is fixed is discharged from between the fixing belt and the pressurizing roller, and delivered to the delivery tray 10.

In this way, a series of image formation processes is completed.

Figure 2:
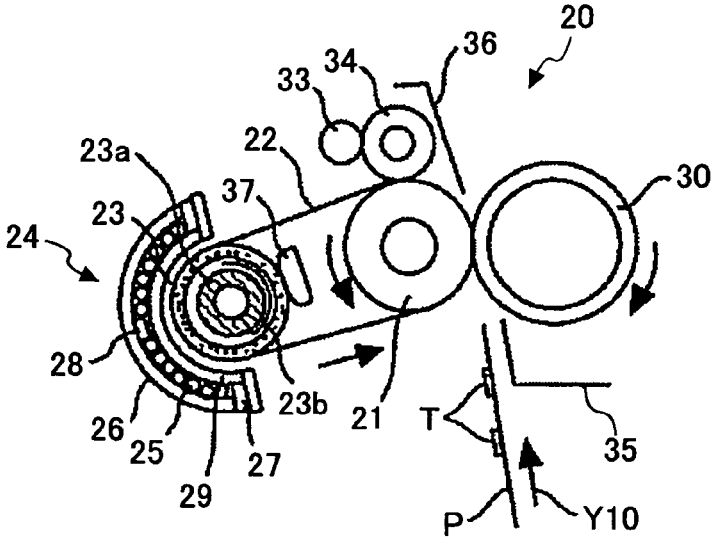
FIG. 2 is a cross-sectional drawing showing a fixing apparatus of the image formation apparatus shown in FIG. 1.

Next, the structure and operation of the fixing apparatus 20 of the image formation apparatus 1 shown in FIG. 2 are described.

As shown in FIG. 2, the fixing apparatus 20 includes a fixing roller 21, a fixing belt 22, and a heating roller 23 (heating member), an IH unit 24, a pressurizing roller 30, a thermostat 37, an oil applying roller 34, a guide board 35, and a separation board 36.

Here, an elastic layer of such as silicone rubber is formed on the surface of the fixing roller 21 that is rotated counterclockwise by a drive unit (not illustrated).

The heating roller 23 serving as the heating member is in the shape of a cylinder, is made of non-magnetic material such as SUS304, and is rotated counterclockwise as shown in FIG. 2. The heating roller 23 includes an internal core 23*a* (serving as the core unit) made of ferromagnetic material such as ferrite, and a shielding member 23*b* made of a material of low permeability, such as copper. The internal core 23*a* serving as the core unit faces a coil unit 25 with the fixing belt 22 in between. Further, the shielding member 23*b* is structured such that both ends of the internal core 23*a* in the width directions may be shielded. The internal core 23*a* and the shielding member 23*b* are rotated in one body. The rotation of the internal core 23*a* and the shielding member 23*b* is independent of the rotation of the heating roller 23

(cylinder object). The structure and operation of the heating roller 23 is described below with reference to FIGS. 3A and 3B.

The fixing belt 22 serving as the fixing member is installed with tension, and supported by the heating roller 23 and the fixing roller 21. The fixing belt 22 is an endless belt, having a multi-layer structure including a base layer of polyimide resin, and, e.g., a heating layer of silver, iron, nickel, etc., and a mold release layer (surface layer) of a fluorine compound, etc. The mold release layer of the fixing belt 22 provides mold release characteristics of toner T.

The IH unit 24 includes a coil unit 25, a coil guide 29, and a core unit that includes a core 26, a side core 27, and a center core 28.

Here, the coil unit 25 is structured with litz wires, each of which consists of thin wires, installed in the width directions (i.e., the directions perpendicular to, i.e., penetrating FIG. 2), and the coil unit 25 covers a part of the fixing belt 22, the part looping along the heating roller 23. The coil guide 29 is made of a high heat-resistant resin material, etc., and supports the coil unit 25 and the core 26, the side core 27 and the center core 28. The core 26, the side core 27, and the center core 28 are made of a high permeability material such as ferrite. The core 26 is installed in the width directions facing the coil unit 25. The side core 27 is installed at the end of the coil unit 25. The center core 28 is installed at the center of the coil unit 25.

Here, "the core unit" of the fixing apparatus 20 includes both core units, countering each other, that contribute to electromagnetic-induction heating. Namely, "the core unit" of the fixing apparatus 20 includes the core 26, the side core 27, the center core 28 of the IH unit 24, and the internal core 23*a* installed in the heating roller 23. By installing the internal core 23*a* in the heating roller 23, a sufficient magnetic field is formed between the core 26 and the internal core 23*a*, and the heating roller 23 and the fixing belt 22 can be efficiently heated.

The pressurization roller 30 includes a metal core, and an elastic layer such as a fluororubber and silicone rubber formed on the metal core. The pressurization roller 30 pressurizes the fixing roller 21 through the fixing belt 22. The recording medium P is conveyed between the fixing belt 22 and the pressurization roller 30, i.e., a fixing nip.

The guide board 35 is arranged on the entrance side of the fixing nip, and guides the recording medium P to the fixing nip.

The separation board 36 is arranged on the exit side of the fixing nip, and helps the recording medium P separate from the fixing belt 22 while guiding the conveyance of the recording medium P.

The oil application roller 34 is in contact with a part of the perimeter of the fixing belt 22. The oil application roller 34 supplies oil, such as silicone oil, to the fixing belt 22. This enhances the mold release characteristic between the toner and the fixing belt 22. In addition, a cleaning roller 33 is provided for removing dirt on the surface of the oil application roller 34.

The thermostat 37 contacts a part of the perimeter of the heating roller 23. When the temperature of the heating roller 23 detected by the thermostat 37 exceeds a predetermined temperature, the thermostat 37 disconnects power supply to the IH unit 24. Further, although illustration is omitted, a thermistor serving as a temperature detection unit is installed on the fixing belt 22 such that the surface temperature of the fixing belt 22 (fixing temperature) can be directly detected for controlling the fixing temperature. In addition, as the temperature detection unit, a thermopile that detects the temperature of the fixing belt 22 without contact can also be used.

The fixing apparatus 20 configured as described above operates as follows.

With reference to FIG. 2, by the rotational driving of the fixing roller 21, the fixing belt 22 travels around in the direction of an arrow, the cylinder object of the heating roller 23 also rotates counterclockwise, and the pressurization roller 30 rotates in the direction of an arrow. The IH unit 24 heats the fixing belt 22 at the countering position. In detail, a high frequency alternating current flows through the coil unit 25, which forms a magnetic field that bidirectionally alternates between the core 26 and the internal core 23*a*. At this time, an eddy current arises in the surface of the heating roller 23, and Joule heat is generated by the electric resistance of the heating roller 23. The fixing belt 22 looping along the heating roller 23 is heated by this Joule heat.

Then, the surface of the fixing belt 22 heated by the IH unit 24 reaches the fixing nip where the fixing belt 22 and the pressurization roller 30 contact, and the toner image T formed by the imaging process as described above on the conveyed recording medium P is heated and fused. In more detail, the recording medium P that supports the toner image T is guided by the guide board 35, and is fed to the fixing nip (i.e., between the fixing belt 22 and the pressurization roller 30) as arrow Y10 that indicates the conveyance direction. Then, the toner image T is fixed to the recording medium P by the heat from the fixing belt 22 and the pressure from the pressurization roller 30, and the recording medium P is discharged from the fixing nip.

Next, the structure and operation of the heating roller 23 that are characteristic of the present embodiment are described in detail with reference to FIGS. 3A and 3B that present front views of the heating roller 23 of the fixing apparatus 20 shown by FIG. 2 in the width directions viewed from the IH unit 24 side. In FIG. 3B, a state wherein the internal core 23*a* (constituted by a small diameter section 23*a*1 and two large diameter sections 23*a*2) and the shielding members 23*b* are rotated by a predetermined angle from a state shown at (A).

Figure 3A:
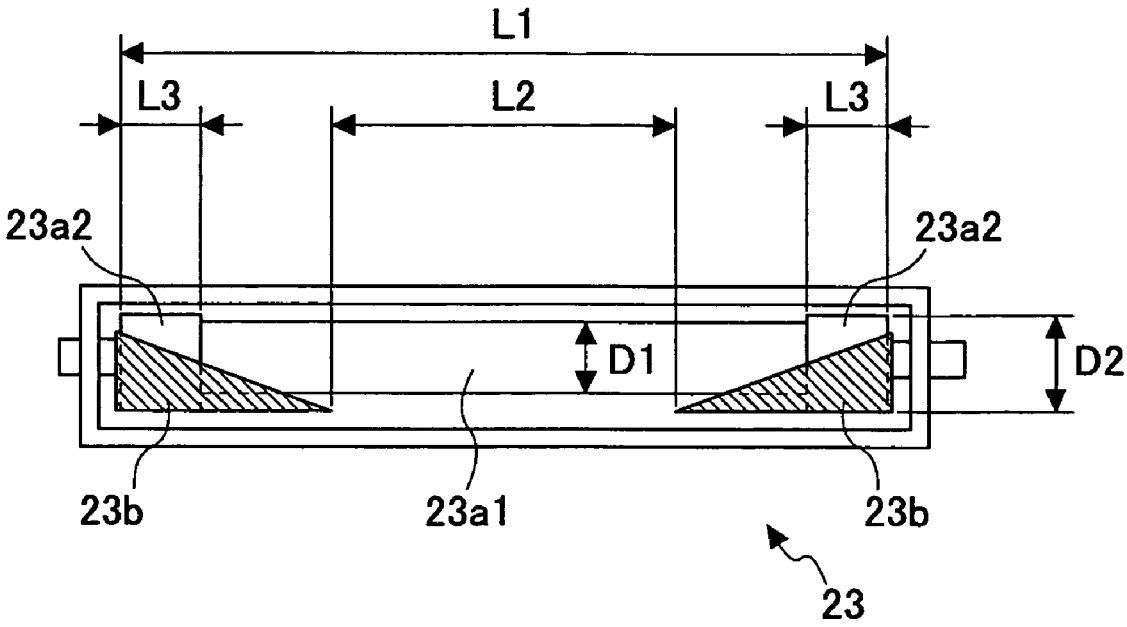
FIGS. 3A and 3B give cross-sectional drawings showing heating rollers installed in the fixing apparatus shown in FIG. 2.
Figure 3B:
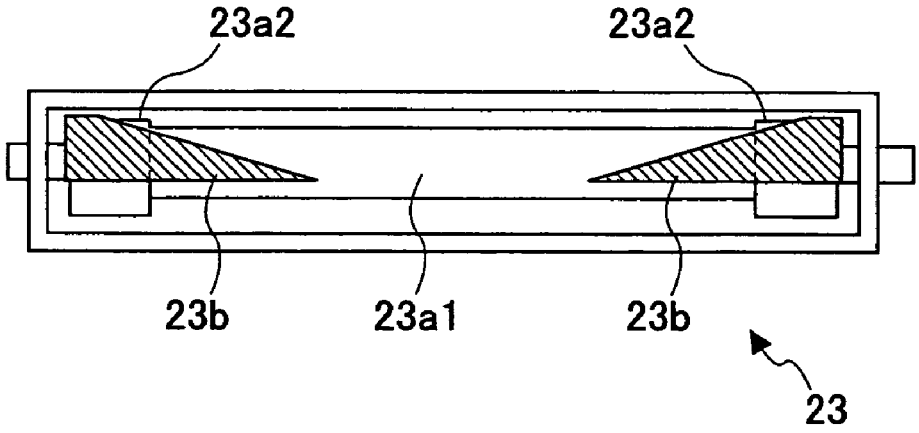

As shown in FIG. 3A, the internal core 23*a* in the shape of a solid cylinder having a width L1, and the shielding members 23*b* are rotatably installed in the hollow cylinder of the heating roller 23. The internal core 23*a* serving as the core unit includes the small diameter section 23*a*1 prepared in the central part in the width directions, and the large diameter sections 23*a*2 prepared at both ends in the width directions. The width of each large diameter section 23*a*2 is L3. The large diameter sections 23*a*2 are formed so that a diameter D2 may be greater than a diameter D1 of the small diameter section 23*a*1. In addition, the form of the internal core 23*a* is not limited to the shape of a solid cylinder, but can also be made into the shape of a hollow cylinder.

At both ends of the internal core 23*a* in the width directions, the shielding member 23*b* is installed in one body. The shielding members 23*b* are formed so that a range of the internal core 23*a* that is to be shielded can be gradually increased from the edges (ends) of the internal core 23*a*, and decreased. By rotating the internal core 23*a* and the shielding members 23*b*, the shielded range is adjusted in the width directions of the internal core 23*a* that counters the coil unit 25 of the IH unit 24. Here, the rotation of the internal core 23*a* and the shielding members 23*b* is driven by a stepping motor (not illustrated) connected to the axle of the internal core 23*a*. This stepping motor is different from a drive motor (not illustrated) for driving the fixing roller 21, the fixing belt 22, and the heating roller 23.

Specifically, when the internal core 23*a* (23*a*1 and 23*a*2) and the shielding members 23*b* in the state as shown in FIG. 3A are rotated by 90° about the axle in the direction of the circumference, the internal core 23*a* and the shielding members 23*b* come to the state as shown in FIG. 3B. At this time, the maximum range of the internal coil 23*a* that counters the IH unit 24 is shielded. The lines of magnetic flux that are to be formed between the internal core 23*a* and the core 26 of the IH unit 24 are intercepted at the range shielded by the shielding members 23*b*. Therefore, a part of the fixing belt 22 corresponding to the shielded range is not fully heated, but only an un-shielded range serves as the heated range of the fixing belt 22, the un-shielded range being the central area indicated by L2.

This state is suitable for continuously fixing recording media P of width L2. Specifically, when recording media P of a predetermined minimum width of an image formation apparatus, for example, 148 mm, the internal core 23*a* and the shielding members 23*b* are put in the position as shown in FIG. 3B, and the fixing process described with reference to FIG. 2 is performed.

Figure 4:
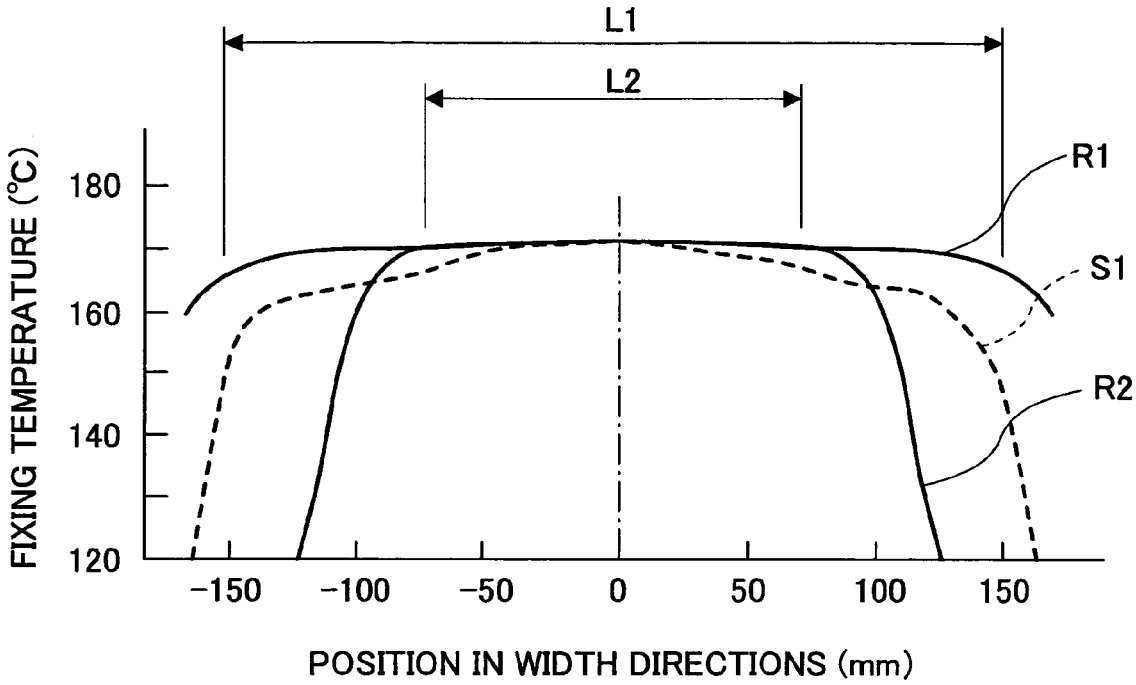
FIG. 4 is a graph showing temperature distribution in the width directions of a fixing belt of the fixing apparatus shown by FIG. 2.

At this time, the fixing temperature distribution in the width directions on the fixing belt 22 is made even throughout the range of the width L2 as shown by a solid line R2 of FIG. 4. Accordingly, satisfactory fixing to the recording medium P of the width L2 is obtained. Further, in the ranges beyond the width L2 of the fixing belt 22, the temperature does not rise, and thermal breakage of the fixing belt 22 can be prevented from occurring.

Here, FIG. 4 is a graph that shows the temperature distribution in the width directions on the fixing belt 22. In FIG. 4, the horizontal axis shows the position in the width directions of the fixing belt 22, and the vertical axis shows the temperature (fixing temperature) of the surface of the fixing belt 22. Here, the position indicated by "0" in the horizontal axis represents the center of the fixing belt 22 in the width directions. A curve in a solid line R1 shows the temperature distribution when the heated range of the fixing belt 22 is maximized by making the range shielded by the shielding members 23*b* (shielded range) minimized. A curve in the solid line R2 shows the temperature distribution when the heated range of the fixing belt 22 is minimized by making the range shielded by the shielding members 23*b* (shielded range) maximized. Further, a curve in a dashed line S1 shows the case wherein the large diameter section 23*a*2 is not installed in the internal core 23*a*, i.e., the conventional practice, the range shielded by the shielding members 23*b* (shielded range) is minimized, and the heated range of the fixing belt 22 is maximized.

When the internal core 23*a* and the shielding members 23*b* are further rotated by 180° in the direction of the circumference from the state shown in FIG. 3B, the shielded range is minimized, and the heating range is maximized. That is, the width L1 is fully heated.

This state is suitable for continuously fixing the recording media P having the width L1. Specifically, when the recording media P having the maximum width, for example, 297 mm, are continuously fixed, the internal core 23*a* and the shielding members 23*b* are rotated by 180° from the state shown in FIG. 3B, and the fixing process described above with reference to FIG. 2 is performed.

At this time, the fixing temperature distribution in the width directions on the fixing belt 22 is made even throughout the range of the width L1, without depression of the fixing temperature at both ends in the width directions as shown by the solid line R1 of FIG. 4. Accordingly, satisfactory fixing is obtained to the recording medium P having the width L1.

The results described above are attributed to the fact that the large diameter section 23*a*2 is formed at both ends in the width directions of the internal core 23*a*, the curve in the solid line R1 being compared with the curve in the dashed line S1 in FIG. 4. The large diameter section 23*a*2 functions as the projecting section that projects toward the coil unit 25 as compared with the small diameter section 23*a*1 in the state of maximizing the heated range of the fixing belt 22.

That is, in the case that the large diameter sections 23*a*2 are not formed, even when the shielding members 23*b* are fully open, the shielding members 23*b* intercept a part of the magnetic flux at both ends in the width directions, and the temperature at both ends in the width directions of the fixing belt 22 falls as shown by the dashed line S1.

In contrast, in the case that the large diameter section 23*a*2 is formed at each end, the distance between the large diameter sections 23*a*2 and the coil unit 25 becomes small, and the flux density formed there becomes great. Accordingly, when the shielding members 23*b* are fully open, even if a part of the magnetic flux at both ends in the width directions is intercepted by the shielding members 23*b*, the flux density at both ends can be held almost equal to the flux density of the small diameter section 23*a*1 (central part). Accordingly, the fixing temperature of both ends in the width directions does not fall, and the whole range of the fixing belt 22 is equally heated as shown by the solid line R1.

Here, in the case that the width of the recording medium P is smaller than L1 and greater than L2, the internal core 23*a* and the shielding members 23*b* are rotated by an angular amount according to the width of the recording medium P such that the heated range of the fixing belt 22 may become equal to the width. In this manner, the fixing temperature distribution in the width directions on the fixing belt 22 is made even throughout the range of the width of the recording medium P, and satisfactory fixing is obtained. Further, at the ranges beyond the width of the recording medium P on the fixing belt 22, the temperature does not rise, and thermal breakage of the fixing belt 22 can be prevented from occurring.

As described above, according to Embodiment 1, the heating range in the width directions of the fixing belt 22 is made variable using the shielding members 23*b* that shield a part of the internal core 23*a*, and the large diameter sections 23*a*2 are formed at both ends of the internal core 23*a* in the width directions such that the distance is made closer to the coil unit 25 than the distance at the central part. In this manner, even if the width of the recording media P that are continuously fixed is small, the temperature rise at both ends of the fixing belt 22 in the width directions is prevented from occurring, and satisfactory fixing is obtained for varied widths of the recording media P.

Embodiment 2

Figure 5:
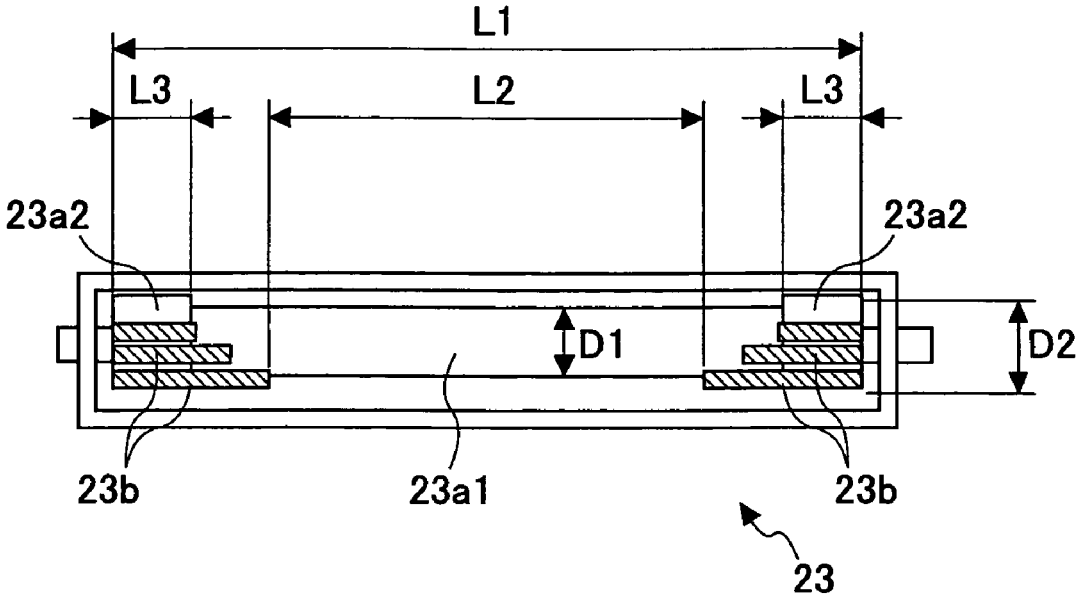
FIG. 5 is a cross-sectional drawing showing the heating roller installed in the fixing apparatus according to Embodiment 2 of the present invention.

Embodiment 2 of the present invention is described in detail with reference to FIG. 5, which is a cross-sectional drawing showing the heating roller 23 installed in the fixing apparatus 20 according to Embodiment 2, and corresponds to FIG. 3A of Embodiment 1. As shown in FIG. 5, the shape of the internal core 23*a* (constituted by the small diameter section 23*a*1 and the large diameter sections 23*a*2), and the shape of the shielding members 23*b* are different from Embodiment 1.

The internal core 23*a* that is shaped like a solid cylinder having the large diameter sections 23*a*2, and the shielding members 23*b* are rotatably installed in the hollow cylinder of the heating roller 23 as shown in FIG. 5.

The large diameter sections 23*a*2 of the internal core 23*a* differ from those of Embodiment 1 in that the center axis of the large-diameter sections 23*a*2 is eccentric to (different from) the center axis of the small diameter section 23*a*1. The direction of the eccentricity is a direction that makes the large diameter sections 23*a*2 project toward the coil unit 25 in reference to the small diameter section 23*a*1 when the range shielded by the shielding members 23*b* (shielded range) is minimized, and the heated range of the fixing belt 22 is maximized.

The shielding members 23*b* that are united with the internal core 23*a* in one body differ from Embodiment 1 in that the shielding members 23*b* are formed such that the perimeter of the internal core 23*a* is shielded in steps (in three steps according to the example of Embodiment 2). The shielded range is made variable by rotating the internal core 23*a* and the shielding members 23*b* also in Embodiment 2, the internal core 23*a* facing the coil unit 25 of the IH unit 24.

The internal core 23*a* and the shielding members 23*b* are rotated by an angular amount such that the heating range matches the width of the recording medium P, which is the same as Embodiment 1. In this manner, the fixing temperature distribution on the fixing belt 22 in the width directions is made even throughout the range of the width of the recording medium P, and satisfactory fixing is obtained. Further, in the range beyond the width of the recording medium P on the fixing belt 22, the temperature does not rise, and thermal breakage of the fixing belt 22 can be prevented from occurring.

Further, when the maximum width of the recording medium P is to be fixed, the heated range of the fixing belt 22 is maximized, and interception of the magnetic flux by the shielding members 23*b* is complemented by the large diameter section 23*a*2 serving as the projecting section. Accordingly, the fixing temperature of all the range of the fixing belt 22 in the width directions is made even as in Embodiment 1, without depressing the fixing temperature at both ends in the width directions.

As described above, also in Embodiment 2, the heated range of the fixing belt 22 in the width directions is made variable using the shielding members 23*b* that shield a part of the internal core 23*a*, and the distances between the coil unit 25 and each of the large diameter sections 23*a*2 at both ends are made smaller than the distance at the central part. In this manner, as in Embodiment 1, even when the recording medium P having a small width is continuously fixed, the temperature at both ends in width directions of the fixing belt 22 is prevented from rising, and satisfactory fixing to various widths of the recording media P is obtained.

Embodiment 3

Embodiment 3 of the present invention is described in detail with reference to FIG. 6 that is a cross-sectional drawing showing the heating roller 23 installed in the fixing apparatus 20 according to Embodiment 3, and corresponds to FIG. 3A of Embodiment 1. The shape of the internal core 23*a* installed in the heating roller 23 of Embodiment 3 differs from Embodiment 1.

Figure 6:
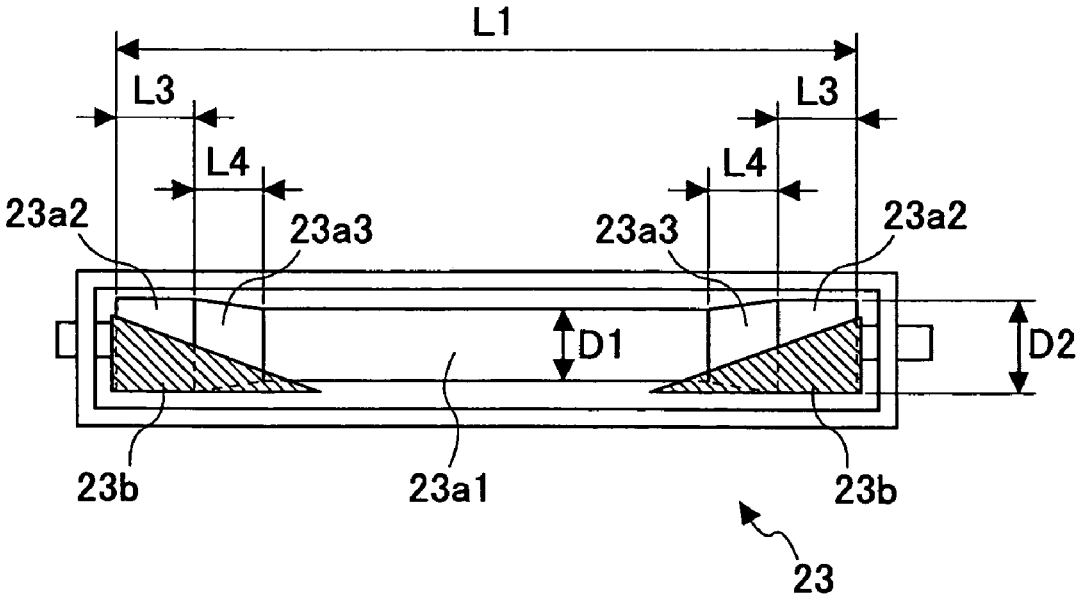
FIG. 6 is a cross-sectional drawing showing the heating roller installed in the fixing apparatus according to Embodiment 3 of the present invention.

The hollow cylinder of the heating roller 23 includes the internal core 23*a* that is shaped like a solid cylinder having the large diameter sections 23*a*2, and the shielding members 23*b* that are rotatably installed as shown in FIG. 6.

The internal core 23*a* differs from Embodiment 1 in that taper sections 23*a*3, each having a width L4, are provided between each large diameter section 23*a*2 and the small diameter section 23*a*1.

The shielding members 23*b* are formed so that the shielded range wherein the internal core 23*a* is shielded can be increased from the edge of the internal core 23*a*, and decreased as in Embodiment 1. The shielded range is made variable by rotating the internal core 23*a* and the shielding members 23*b*.

According to Embodiment 3, the internal core 23*a* and the shielding members 23*b* are rotated by an angular amount such that the heating range matches the width of the recording medium P, which is the same as Embodiment 1. Accordingly, the fixing temperature distribution on the fixing belt 22 in the width directions is made even throughout the range of the width of the recording medium P, and satisfactory fixing is obtained. Further, in the range beyond the width of the recording medium P on the fixing belt 22, the temperature is prevented from rising, and thermal breakage of the fixing belt 22 is avoided.

Further, when the recording medium P having the maximum width is fixed, the heated range of the fixing belt 22 is maximized. Even in this case, the interception of a part of the magnetic flux by the shielding members 23*b* is compensated for by the large diameter sections 23*a*2 and the taper sections 23*a*3. In this manner, the fixing temperature throughout the range of the fixing belt 22 in the width directions is made even, with the fixing temperature at both ends in the width directions being maintained, as in Embodiment 1.

As described above, also in Embodiment 3, the heated range of the fixing belt 22 in the width directions is made variable by rotating the shielding members 23*b* that shield a part of the internal core 23*a*, and the distance between the internal core 23*a* and the coil unit 25 is made shorter at both ends of the internal core 23*a* by preparing the large diameter sections 23*a*2 and the taper sections 23*a*3 than the distance at the central part. In this manner, as in Embodiment 1, when the recording media P having a short width are continuously fixed, the temperature of both ends of the fixing belt 22 in the width directions is prevented from rising, and satisfactory fixing is obtained to various widths of the recording media P.

The present invention has been applied to Embodiments 1, 2 and 3 above wherein the fixing apparatus 20, based on electromagnetic-induction, uses the fixing belt method, and includes the heating roller 23 in which the internal core 23*a* is installed.

Nevertheless, the present invention is applicable to an electromagnetic-induction type fixing apparatus that includes a core unit (IH unit) around which a coil is wound, the core unit being arranged in the fixing roller 21, dispensing with the fixing belt 22 and the heating roller 23. That is, in order to prevent the magnetic flux at both ends in the width directions from weakening by preparing a shielding member that has a heat insulating nature between the core unit, the coil, and the fixing roller functioning as a fixing member, a projecting section, such as the large diameter section, is prepared at both ends of the core unit. In this manner, almost the same effect as Embodiments 1, 2 and 3 can be obtained.

Further, according to Embodiments 1, 2, and 3 above, the shielding members 23*b* are prepared at both ends of the internal core 23*a* installed in the heating roller 23 among the core units of the fixing apparatus 20. Nevertheless, the shielding members 23*b* that shield a part of the core 26 in the width directions can be prepared to the core 26 of the IH unit 24 such that the heated range of the fixing belt 22 in the width directions is made variable. In this case also, the fixing temperature drop at both ends when the heating range is maximized can be prevented from occurring by projecting the both ends of the core 26 toward the coil unit 25.

Embodiment 4

Embodiment 4 of the present invention is described with reference to FIG. 7 and FIG. 8.

Figure 7:
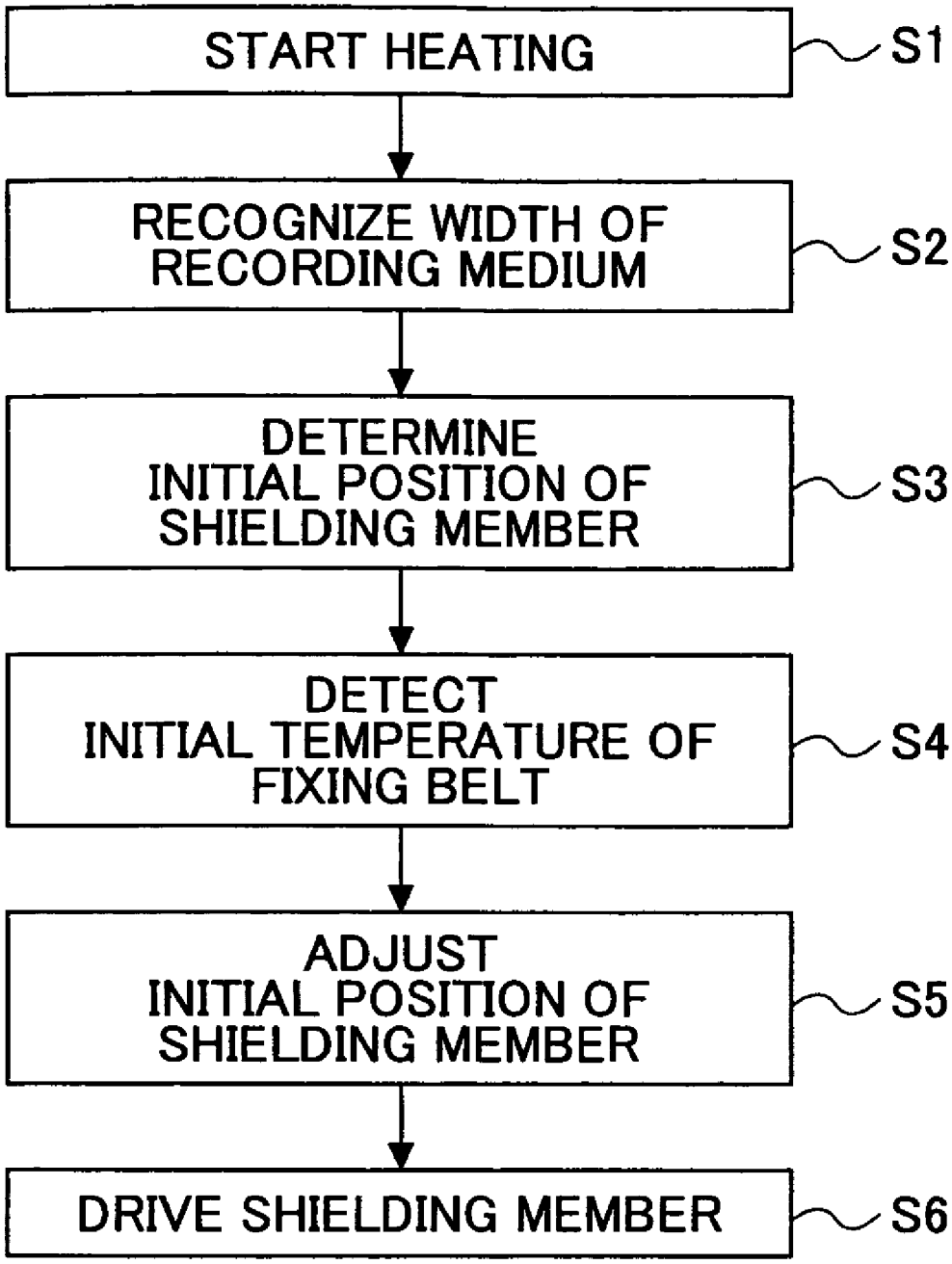
FIG. 7 is a flowchart showing control of the fixing apparatus according to Embodiment 4 of the present invention.

FIG. 7 is a flowchart showing control of the fixing apparatus according to Embodiment 4. Embodiment 4 differs from Embodiment 1 in that the position of the shielding members 23*b* installed in the heating roller 23 is finely tuned.

Otherwise, the structure of the fixing apparatus according to Embodiment 4 is the same as the fixing apparatus 20 of Embodiment 1 described above. With reference to FIGS. 3A and 3B, in the heating roller 23, the internal core 23*a* (23*a*1, 23*a*2) and the shielding members 23*b* are installed. The shielding members 23*b* are united with the internal core 23*a* in one body, and are formed so that the range of the shielded surface of the internal core 23*a* may be gradually increased starting from the end, and decreased. In other words, the shielding members 23*b* have adjustment positions that form a taper shape.

By rotating the internal core 23*a* and the shielding members 23*b*, the shielded range of the internal core 23*a* is made variable, the internal core 23*a* countering the coil unit 25 (especially, the center core 28) of the IH unit 24. In this way, the heating range of the fixing belt 22 in the width directions is made variable according to the size of the width directions of the recording medium P.

At this time, the fixing apparatus according to Embodiment 4 controls to drive the shielding members 23*b* such that a fine adjustment is carried out.

In the following, the control concerning fine tuning of the heating range is described with reference to FIG. 7.

First, at Step S1, power is supplied to the IH unit 24, and heating of the heating roller 23 and the fixing belt 22 is started. At Step S2, the size in the width directions of the recording medium P is recognized based on such as user's operational information, and size detection carried out by a sensor.

Then, based on the size of the recording medium P recognized at Step S2, an initial position of the shielding members 23*b* is determined at Step S3. Specifically, the shielding members 23*b* have two or more adjustment positions for each size (for example, A4 size). From the adjustment positions, an initial position (a default position that does not require fine tuning) for controlling purposes is determined.

Then, the initial temperature of the fixing belt 22 is detected by a thermistor (not illustrated), and is read into a control unit at Step S4. Here, the thermistor serving as a temperature detection unit is installed at the end of the fixing belt 22 in the width directions (which is a position slightly outside of the maximum width of the recording medium P), and on the upstream side of the fixing nip.

Here, although the temperature of the fixing belt 22 is detected in the present embodiment, the temperature of the heating roller 23 may be used instead. Further, the installation position of the thermistor is not limited to the position described above.

At Step S5, based on the temperature of the fixing belt 22 detected at Step S4, the initial position of the shielding members 23*b* is adjusted if necessary. In more detail, the adjustment position that should be finely tuned is determined for controlling purposes from two or more adjustment positions of the shielding members 23*b*. Specifically, if the temperature of the end of the fixing belt 22 is higher than a predetermined temperature, an adjustment position is chosen so that the heating range may become smaller than the default position. On the other hand, if the temperature of the end of the fixing belt 22 is lower than the predetermined temperature, an adjustment position is chosen so that the heating range may become greater than the default position. In addition, if the temperature of the end of the fixing belt 22 is within a predetermined range, fine tuning of the adjustment position is not performed, and the heating range provided by the default position is used.

Then, at Step S6, based on the adjustment position determined at Step S5, the shielding members 23*b* are driven. In detail, the stepping motor is driven so that the shielding members 23*b* and the internal core 23*a* are rotated by a predetermined angle. In this way, fine tuning of the heating range is carried out according to the size of the recording medium P.

Figure 8:
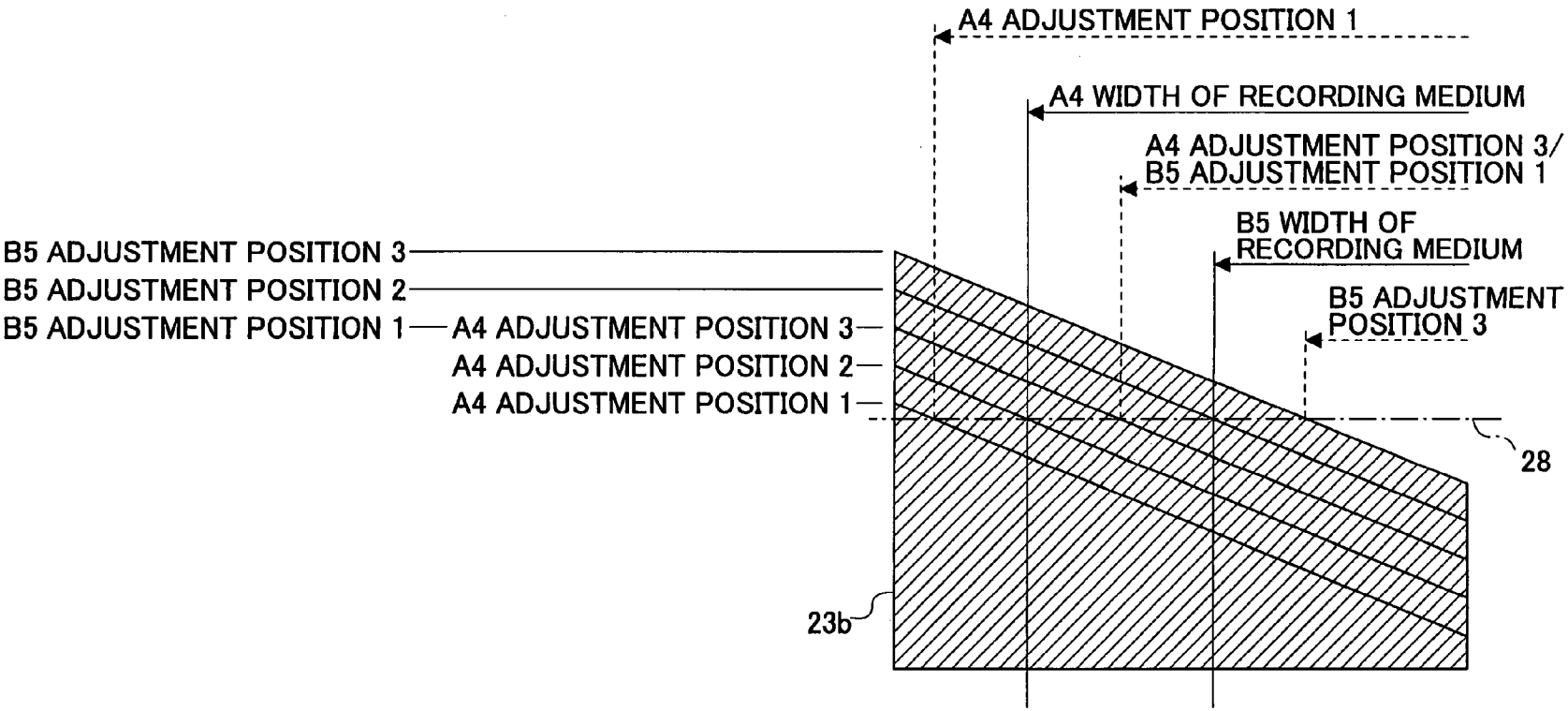
FIG. 8 is a graph showing relations between adjustment positions of a shielding member and heating ranges.

A specific example is explained referring to FIG. 8, which demonstrates relations between the adjustment positions of the shielding members 23*b* and the heating range that is finely tuned. In this example, three adjustment positions are set up for each size of the recording medium P. That is, when the size in the width directions is that of A4, one of A4 adjustment positions 1 through 3 is chosen; and when the size in the width directions is that of B5, one of B5 adjustment positions 1 through 3 is chosen. Here, the A4 adjustment position 3 and the B5 adjustment position 1 are the same. By sharing an adjustment position between sizes, the number of adjustment positions as a whole can be reduced, and control is simplified.

The shielding members 23*b* slide in the vertical direction of FIG. 8 (the movement in fact being the rotation as described above), and a position where the center core 28 of the IH unit 24 and the slope of the shielding members 23*b* overlap serves as the actual heating range. FIG. 8 shows the case wherein the B5 adjustment position 3 serves as the heating range.

That is, if the temperature of the end of the fixing belt 22 is within the predetermined range, the B5 adjustment position 2 is chosen, and the heating range is made in agreement with the width of B5. If the temperature of the end of the fixing belt 22 is higher than the predetermined temperature, the B5 adjustment position 3 is chosen, and the heating range is made smaller than the width of B5. If the temperature of the end of the fixing belt 22 is lower than the predetermined temperature, the B5 adjustment position 1 is chosen, and the heating range is made greater than the width of B5. The same control is carried out where the width of the recording medium P is A4.

As described above, even when the temperature distribution in the width directions is uneven when starting heating the fixing belt 22, the optimal heating range according to the width of the recording medium P can be obtained by finely tuning the heating range. In this way, the temperature distribution is made even throughout the heating range according to the width of the recording medium P; and "hot offset" and "cold offset" can be prevented from occurring at both ends in the width directions of the recording medium P after fixing.

Here, according to Embodiment 4, the shielded range by the shielding members 23*b* is finely tuned based on the temperature at the end of the fixing belt 22. However, the fine adjustment of the shielded range by the shielding members 23*b* can be carried out by providing a recognition unit, to which information about the width directions size and the number of sheets of the recording medium P to be fixed is input, and the fine adjustment is carried out based on a recognition result of the recognition unit. In this case, the temperature distribution in the width directions that slightly fluctuates depending on the number of sheets of small size paper can be rectified by finely tuning the shielded range by the shielding member 23*b*.

Further, according to Embodiment 4, the shielded range by the shielding members 23*b* is finely tuned based on the temperature of the end of the fixing belt 22 when starting heating. However, the shielded range by the shielding member 23*b* can also be finely tuned after heating is started, i.e., during fixing operations based on the temperature of the end of the fixing belt 22. In this way, the fluctuation of the temperature distribution in the width directions can be rectified.

As described above, according to Embodiment 4, the large diameter sections 23*a*2 are provided at both ends in the width directions of the core unit 23*a*, and the heating range in the width directions of the fixing belt 22 can be finely tuned using the shielding members 23*b*. In this manner, even when the recording media P having a short width are continuously fixed, the temperature at both ends in the width directions of the fixing belt 22 is prevented from rising, and satisfactory fixing is obtained to the recording media P with various widths.

Embodiment 5

Embodiment 5 of the present invention is described with reference to FIG. 9, which corresponds to FIG. 3A relative to Embodiment 1, and shows the heating roller 23 of the fixing apparatus according to Embodiment 5. The internal core 23*a* installed in the heating roller 23 according to Embodiment 5 does not have a large diameter section such as the large diameter section 23*a*2, which is different from that of Embodiment 1.

Figure 9:
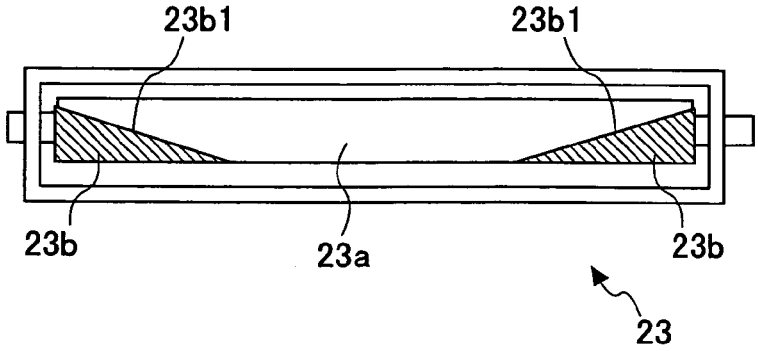
FIG. 9 is a cross-sectional drawing showing the heating roller installed in the fixing apparatus according to Embodiment 5 of the present invention.

As shown in FIG. 9, the internal core 23*a* and the shielding members 23*b* are installed in the heating roller 23. Note that the internal core 23*a* does not have a large diameter section. The shielding members 23*b* have the adjustment positions 23*b*1 formed in the shape of a taper.

According to Embodiment 5, the heating range (conversely, the shield range) is finely tuned according to the temperature of the end of the fixing belt 22 by driving the shielding members 23*b*, as is the case with Embodiment 4.

Although the effect of the large diameter section 23*a*2 is not available in Embodiment 5, an effect similar to that of the large diameter section 23*a*2 is available to a certain extent by finely tuning the heating range based on the temperature of the end of the fixing belt 22. That is, when the temperature of the end of the fixing belt 22 becomes higher or lower than the temperature at the central part, the temperature distribution in the width directions can be made even to some extent by finely tuning the heating range.

As described above, Embodiment 5 is structured such that the heating range in the width directions of the fixing belt 22 can be finely tuned using the shielding members 23*b*. In this manner, the temperature at both ends in the width directions of the fixing belt 22 is prevented from rising, even when the recording media P having a small width are continuously fixed, and satisfactory fixing is obtained to the recording media P with various widths.

Embodiment 6

Embodiment 6 of the present invention is described with reference to FIG. 10, which is a projected diagram showing the shielding member 23*b* installed in the heating roller 23. The shielding member 23*b* according to Embodiment 6 has the adjustment positions 23*b*1 formed in the shape of a stage, which is different from the shielding member 23*b* of Embodiment 5 wherein the adjustment positions 23*b*1 are formed in the shape of a taper.

Figure 10:
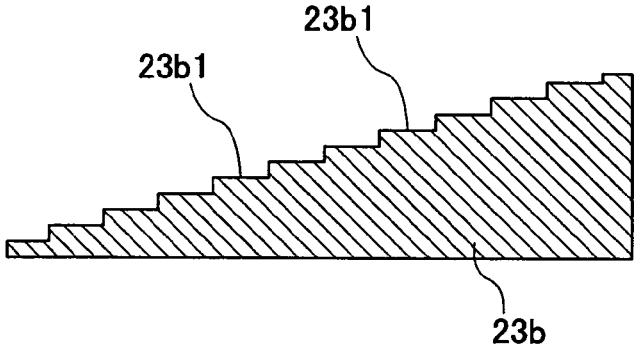
FIG. 10 is a projected diagram of the shielding member installed in the heating roller according to Embodiment 6 of the present invention.

As shown in FIG. 10, the shielding member 23*b* installed in the heating roller 23 has the adjustment positions 23*b*1 (which are ridgelines of circularly curved surfaces that counter the center core 28) formed in the shape of a stage.

According to Embodiment 6, the heating range is finely tuned according to the temperature of the end of the fixing belt 22 by driving the shielding members 23*b*, which is the same as Embodiment 5.

According to Embodiment 6, two or more steps of the stage serve as the adjustment positions for each size of the recording medium P, the heating range can be finely tuned for each size by driving the shielding members 23*b*, which is the same as Embodiment 5.

As described above, Embodiment 6 is structured such that the heating range in the width directions of the fixing belt 22 can be finely tuned using the shielding members 23*b*. In this manner, the temperature at both ends in the width directions of the fixing belt 22 is prevented from rising, even when the recording media P having a small width are continuously fixed, and satisfactory fixing is obtained to the recording media P having various widths.

Embodiment 7

Embodiment 7 of the present invention is described with reference to FIG. 11, which is a projected diagram showing the shielding member 23*b* of the heating roller 23 according to Embodiment 7.

Figure 11:
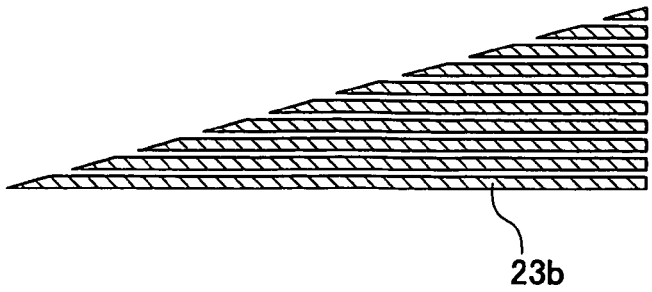
FIG. 11 is a projected diagram of the shielding member installed in the heating roller according to Embodiment 7 of the present invention.

FIG. 11 corresponds to FIG. 10 relative to Embodiment 6. The shielding member 23*b* of Embodiment 7 is divided into two or more pieces, which is the difference from Embodiment 6.

As shown in FIG. 11, the shielding member 23*b* installed in the heating roller 23 is divided into two or more belt-like pieces along with the perimeter of the internal core 23*a*, and has the adjustment position formed in the shape of a taper. The shielding members 23*b* divided into the pieces are directly stuck to the internal core 23*a*. According to Embodiment 7, the heating range is finely tuned according to the temperature of the end of the fixing belt 22, as Embodiment 6, by driving the shielding members 23*b* that are united in one body with the internal core 23*a*.

According to Embodiment 7, the shielding members 23*b* are divided into the pieces corresponding to the sizes of the recording media P, each piece serving as an adjustment position. In this manner, the heating range is finely tuned for each size by driving the shielding members 23*b*, which is the same as Embodiment 6.

As described above, Embodiment 7 is structured such that the heating range in the width directions of the fixing belt 22 can be finely tuned using the shielding members 23*b*. Accordingly, the temperature at both ends in the width directions of the fixing belt 22 is prevented from rising, even when the recording media P having a small width are continuously fixed, and satisfactory fixing is obtained to the recording media P having various widths.

In addition, it is evident that the present invention is neither limited to Embodiments described above nor limited to what is suggested by Embodiments. Variations and modifications may be made without departing from the scope of the present invention. Further, the quantity, the position, the form, the shape, and the like of the components described above are not limited to what are described, but the present invention can be applied to an implementation that uses a quantity, position, form, shape, and the like different from Embodiments.

The present application is based on Japanese Priority Applications No. 2004-034510 filed on Feb. 12, 2004, and No. 2004-189438 filed on Jun. 28, 2004 with the Japanese Patent Office, the entire contents of which are hereby incorporated by reference.

What is claimed is:

1. A fixing apparatus, comprising:

a fixing member that heats a toner image formed on a recording medium, and fixes the toner image to the recording medium;

a coil unit installed in width directions, which are directions of a width of the recording medium, facing the fixing member;

a core unit that faces the coil unit; and a shielding member that makes a heating range variable by shielding a part of the core unit in the width directions, the heating range being a range of the fixing member in the width directions, the fixing member being heated by electromagnetic induction when a current flows through the coil unit;

wherein the core unit has a projecting section at an end of the core unit in the width direction, the projecting section projecting toward the coil unit in reference to a central portion of the core unit.

2. The fixing apparatus as claimed in claim 1, wherein the projecting section of the core unit counters the coil unit at least when the heating range is maximized.

3. The fixing apparatus as claimed in claim 2, wherein the core unit is shaped like one of a hollow cylinder and a solid cylinder, and a large diameter section is provided at the end of the core unit in the width directions, the large diameter section serving as the projecting section.

4. The fixing apparatus as claimed in claim 3, wherein the large diameter section is eccentric to the central portion of the core unit.

5. The fixing apparatus as claimed in claim 1, wherein the core unit counters the coil unit with the fixing member in-between.

6. The fixing apparatus as claimed in claim 1, wherein the fixing member is a fixing belt installed with tension, and supported by a heating roller and a fixing roller, the heating roller is arranged in a position that counters the coil unit with the fixing belt in-between, the coil unit countering an outer side of the fixing belt, the fixing roller is arranged in a position that counters a pressurization roller that pressurizes the recording medium conveyed by the fixing belt, and the core unit and the shielding member are arranged in the heating roller.

7. The fixing apparatus as claimed in claim 6, wherein the core unit and the shielding member are rotatably structured in one body, and the heating range is made variable by rotating the core unit and the shielding member.

8. The fixing apparatus as claimed in claim 7, wherein the shielding member is formed such that the heating range can be gradually increased and decreased, and the shielding member is driven so that the heating range is finely tuned according to the width of the recording medium.

9. The fixing apparatus as claimed in claim 8, wherein the shielding member has a plurality of adjustment positions that provide fine tuning capability to each of given widths of the recording medium.

10. The fixing apparatus as claimed in claim 9, wherein the adjustment positions take a shape of one of a taper and a stage.

11. The fixing apparatus as claimed in claim 8, further comprising:

a temperature detection unit to detect a temperature of one of the fixing member and a heating member that contacts the fixing member; wherein the shielding member is driven based on a detection result of the temperature detection unit.

12. The fixing apparatus as claimed in claim 11, wherein the temperature detection unit is installed at an end in the width directions of the fixing member, or the heating member, as applicable.

13. The fixing apparatus as claimed in claim 11, wherein the temperature detection unit detects a temperature when heating the fixing member, or the heating member, as applicable, is started.

14. The fixing apparatus as claimed in claim 11, wherein the shielding member is driven so that the heating range becomes smaller when the detected temperature of the temperature detection unit is higher than a predetermined temperature.

15. The fixing apparatus as claimed in claim 8, further comprising:

a recognizing unit to recognize, beforehand, the width and the number of sheets of the recording medium to be fixed; wherein the shielding member is driven based on a recognition result of the recognizing unit.

16. A fixing apparatus, comprising:

a fixing member that heats a toner image formed on a recording medium, and fixes the toner image to the recording medium;

a coil unit installed in width directions, which are directions of a width of the recording medium, facing the fixing member;

a core unit that faces the coil unit; and a shielding member that makes a heating range variable by shielding a part of the core unit in the width directions, the heating range being a range of the fixing member in the width directions, the fixing medium being heated by electromagnetic induction when a current flows through the coil unit;

wherein the shielding member is formed so that the heating range can be gradually increased and decreased, and the shielding member is driven so that the heating range is finely tuned according to the width of the recording medium.

17. The fixing apparatus as claimed in claim 16, wherein the shielding member has a plurality of adjustment positions that provide the fine tuning capability to each of given widths of the recording medium.

18. The fixing apparatus as claimed in claim 17, wherein the adjustment positions take a shape of one of a taper and a stage.

19. The fixing apparatus as claimed in claim 16, further comprising:

a temperature detection unit to detect a temperature of one of the fixing member and a heating member that contacts the fixing member; wherein the shielding member is driven based on a detection result of the temperature detection unit.

20. The fixing apparatus as claimed in claim 19, wherein the temperature detection unit is installed at an end in the width directions of the fixing member or the heating member, as applicable.

21. The fixing apparatus as claimed in claim 19, wherein the temperature detection unit detects a temperature when heating of the fixing member or the heating member, as applicable, is started.

22. The fixing apparatus as claimed in claim 19, wherein the shielding member is driven so that the heating range becomes smaller when the detected temperature of the temperature detection unit is higher than a predetermined temperature.

23. The fixing apparatus as claimed in claim 16, further comprising:

a recognition unit to recognize, beforehand, the width and the number of sheets of the recording medium to be fixed; wherein the shielding member is driven based on the recognizing result of the recognizing unit.

24. The fixing apparatus as claimed in claim 16, wherein the core unit counters the coil unit with the fixing member in-between.

25. The fixing apparatus as claimed in claim 16, wherein the fixing member is a fixing belt installed with tension, and supported by a heating roller and a fixing roller, the heating roller is arranged in a position that counters the coil unit with the fixing belt in-between, the coil unit countering an outer side of the fixing belt, the fixing roller is arranged in a position that counters a pressurization roller that pressurizes the recording medium conveyed by the fixing belt, and the core unit and the shielding member are arranged in the heating roller.

26. The fixing apparatus as claimed in claim 25, wherein the core unit and the shielding member are rotatably structured in one body, and the heating range is made variable by rotating the core unit and the shielding member.

27. An image formation apparatus, comprising:

the fixing apparatus as claimed in any one of claims 1 through 26.

* * * * *